United States Patent [19]

Carver et al.

[11] Patent Number: 4,580,826

[45] Date of Patent: Apr. 8, 1986

[54] RETRIEVAL TOOL

[76] Inventors: Herman C. Carver, 1105A Sequoia, Bakersfield, Calif. 93308; Michael R. Kent, 2209 Panama La., Bakersfield, Calif. 93307; Bernie L. Chalmers, 2511 Cameo Ct., Bakersfield, Calif. 93304

[21] Appl. No.: 581,252

[22] Filed: Feb. 17, 1984

[51] Int. Cl.[4] ..... E21B 31/20

[52] U.S. Cl. ..... 294/86.17; 294/86.12; 294/86.24

[58] Field of Search ..... 294/86.1, 86.12, 86.14, 294/86.17–86.22, 86.24, 86.25, 86.34, 96

[56] References Cited

U.S. PATENT DOCUMENTS

| | | | |
|---|---|---|---|
| 672,154 | 4/1901 | Taylor | 294/86.12 |
| 1,087,262 | 2/1914 | Schildwachter | 294/86.14 |
| 1,163,561 | 12/1915 | Schildwachter | 294/86.1 |
| 1,363,226 | 12/1920 | Bonawitt | 294/86.24 |
| 1,589,896 | 6/1926 | Rape | 294/86.12 |
| 1,839,493 | 1/1932 | Nutter | 294/86.19 |
| 2,647,008 | 7/1953 | Stewart et al. | 294/86.34 |
| 2,886,369 | 5/1959 | Decuir | 294/86.12 |

*Primary Examiner*—Johnny D. Cherry
*Attorney, Agent, or Firm*—Donald D. Mon

[57] ABSTRACT

A retrieval tool to retrieve loose pipe and the like from a well. A bell-mouth centering device is sent down the hole to center the pipe, and a spear passes through the centering device into the pipe. Gripping devices carried by the spear engage the pipe so as to pull it to the surface. The gripping devices are able to cut a thread in the pipe so as to be releasable from the pipe if desired.

7 Claims, 4 Drawing Figures

FIG. 1
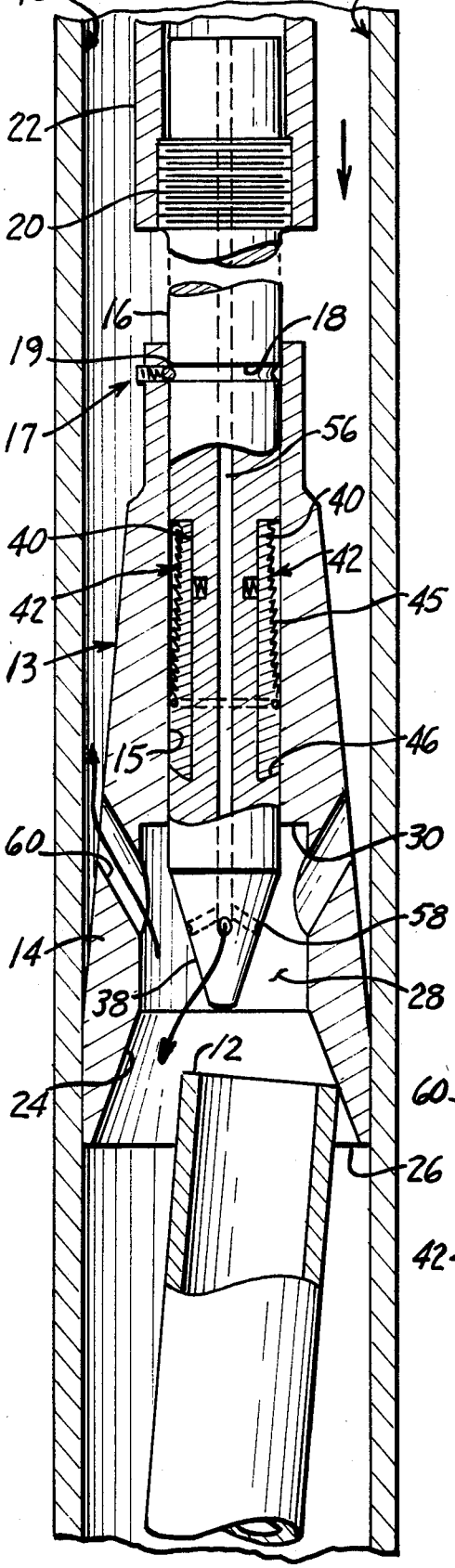
FIG. 2
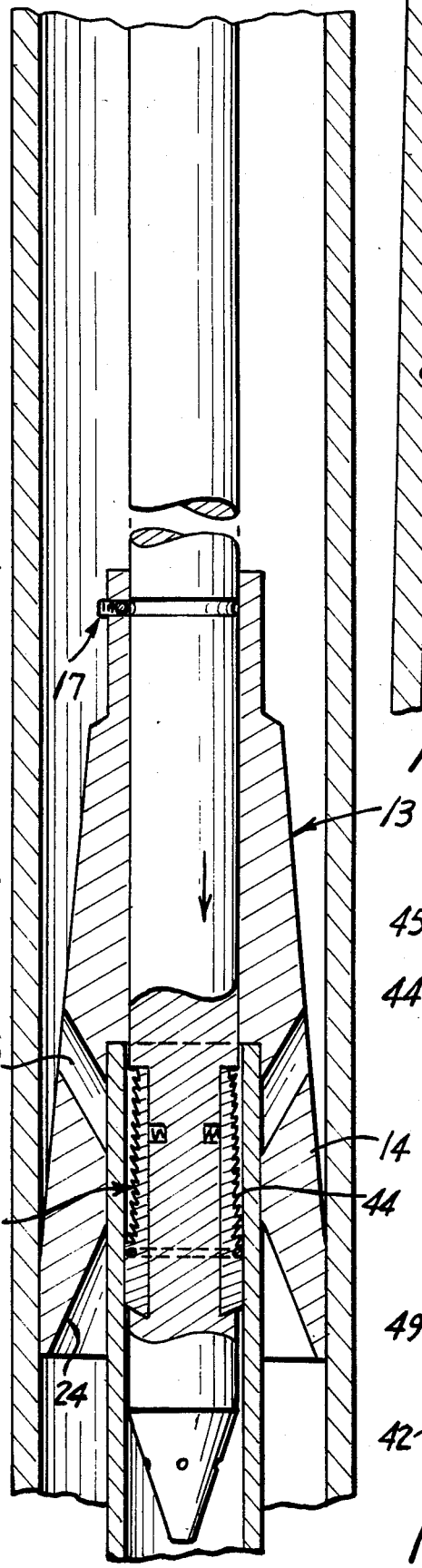
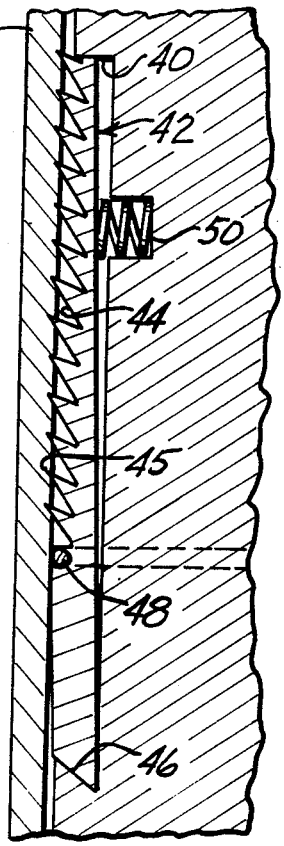
FIG. 3
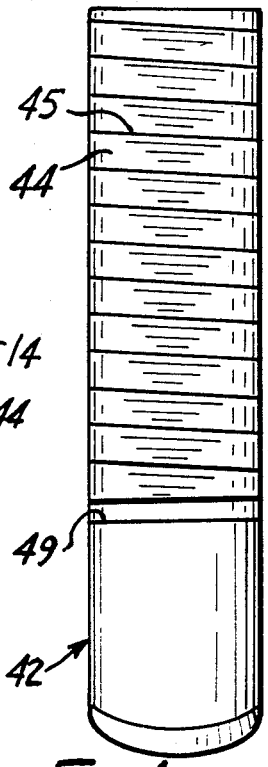
FIG. 4

RETRIEVAL TOOL

FIELD OF INVENTION

This invention relates to retrieving (fishing) tools for use in wells, and more particularly relates to a tool to retrieve lost pipe or hollow rod.

BACKGROUND OF THE INVENTION

Strings of drill pipe or hollow rod are frequently lost down a well. They are lost by breakage of the pipe, or by unintended unthreading at the joinder of two pipe sections. In either event, the downhole portion of the string is out of direct reach from the surface, and it is necessary to retrieve it with the use of a retrieval tool.

The lost portion can involve a variety of problems, none of which can be directly observed from the surface. For one, its upper end may lean against the casing, so that a retrieval tool which operates only at the well axis cannot find it or grab it. For another it may be so strongly retained in the well that the tool cannot withdraw it. It is then necessary to disengage the tool. If the tool is so strongly engaged to the string that it cannot separate from it, an already miserable but potentially correctible problem becomes nearly unsolvable. For another, to provide gripping means which are readily disengaged usually involves insufficient grasping strength, and actuating means which is so complicated as to be unreliable.

It is an object of the present invention to provide a retrieval tool for engaging the free end of a string whether the end is initially centered in the well or not.

Another object of this invention is to provide a simple but reliable gripping means which can readily be disengaged from the string if it becomes necessary to separate them.

Another object of the present invention is to provide means for removing sediment ahead of the retrieval tool so it can reach and reliably engage the lost portion.

BRIEF DESCRIPTION OF THE INVENTION

A retrieval tool according to this invention is passed down into the well to the upper end of a broken or separated pipe or hollow rod, and is engaged to it so as to hold it so it can be pulled out. It includes a bell-mouth centering means having an interior tapered shape which extends from a larger diameter nearly equal to the diameter of the casing, to a lesser diameter where it intersects a socket. Thus, when it strikes an off-center pipe or rod, it will deflect it toward the center of the centering means and into the socket.

Gripping means including a spear passes axially through the centering means, and is axially slidable therein. It is pointed, and enters the pipe. On its outside surface is a gripping means, which is biased outwardly so as to engage the pipe when the spear is pulled upwardly.

According to a preferred but optional feature of the invention, the gripping means comprises ridged plates that are pivotally mounted in respective recesses. Thus they provide minimum resistance during downward movement, and maximum resistance during upward movement.

The spear and centering means are latched together for insertion into a well. Once the free end of the pipe string is seated in the socket, a downward thrusting movement of the spear releases the latching mechanism, allowing the spear to move into the free end of the pipe string. The biasing means behind the metal plates and the shape of the barbs combine to cause a strong grip on the pipe when the tool is withdrawn.

The teeth are formed with a pitch angle in a manner similar to thread-tapping teeth used for tapping locking thread. The tool can be removed from the pipe by turning the spear so the teeth cut their way out by forming a thread on the inside of the pipe. This can provide for down-hole, or out-of-the-hole release.

An optional feature of the invention is the provision of means for clearing sediment around the end of the pipe. The spear is provided with a through bore terminating in a port in the pointed end. The bell-mouth centering means has one or more channels communicating from the pipe socket to the well bore above the bell-mouth means. Fluid forced through the spear causes sediment to be washed upwardly through the tool, thereby enabling the tool to reach and cleanly engage the pipe.

The above and other features of the invention will be fully understood from the following detailed description and the accompanying drawings, in which:

BRIEF DESCRIPTION OF THE DRAWINGS

FIG. 1 is a sectional view of well bore and a retrieving tool according to the invention;

FIG. 2 is a sectional view illustrating a subsequent operating position;

FIG. 3 is a partial axial section of a gripper plate; and

FIG. 4 is a side elevation of the plate of FIG. 3.

DETAILED DESCRIPTION OF THE INVENTION

Referring to FIG. 1 there is shown a well bore 10 and a casing 11. The upper end of a broken or separated pipe string 12 is shown, which is to be retrieved by tool 13. Retrieving tool 13 is comprised of a bell-mouth centering means 14 with an axial passage 15, and a spear 16 in the passage. These are axially slidable relative to one another. In the condition of FIG. 1 they are held in the illustrated position by latching means 17. Means 17 is a groove 18 in the spear, and a spring-loaded ball 19 in the wall of passage 15. The spear has threads 20 engaged to a pipe or rod string 22. The tool is inserted into the well by string 22.

Centering means 14 has an interior tapered surface 24 whose largest diameter (near its lower end 26) is sufficiently large as to engage and deflect toward the center the end of a pipe which is leaning against the casing. This is the worst case. If the pipe end is spaced from the casing, then a portion of the tapered surface farther into the tool will engage it. The surface, which is circular, tapers inwardly and upwardly, perhaps but not necessarily conically. It tapers inwardly toward a socket 28. A seat 30 is formed at the upper end of the socket. The socket has a surrounding wall to trap a pipe which enters it. Passage 15 enters the socket.

Spear 16 has a pointed tip 38 which is initially in the socket in the position shown in FIG. 1, and is held in this position by the latching means until a later event occurs.

Recesses 40 in the surface of the spear receive metal plates 42 having ridge-like tooth or barbs formed on their surface. According to the preferred embodiment there are at least two such recesses and plates, (there may be more) spaced around the spear, and perhaps also axially along the spear. Metal plates 42 are pivotally mounted at an undercut end 46 of each recess 40 and are held against falling out by a retaining ring 48 which encircles the spear, and fits in a groove 49 in the plates and in the spear itself. The ring might be such as a springy split metal retainer ring, or an elastic band. The upper ends of metal plates 42 are biased radially outward from the spear by bias coil springs 50.

The formation of teeth 44 on metal plates 42 is shown in greater detail in FIGS. 3 and 4. As stated above, metal plate 42 is pivotally seated in the undercut end 46 of recess 40. The plates are held against sidewise movement by engagement with the axially-extending side walls of the recesses. Teeth 44 extend outwardly and upwardly, so that they offer little resistance to axial downward insertion movement of spear 16. The bias normally forces them outwardly of the spear wall, but in downward movement, their shape enables them to be cammed back into the recess. Thus, when the spear is thrust into the upper end of string 12, plates 42 can deflect into recesses 40 allowing the spear to be easily inserted in the end of the pipe.

The plates are thinner toward their upper ends. This is because the objective is to have a strong and sensibly uniform grip between the teeth 44 and the wall of the pipe along the full axial length of the plate. This means that all of the teeth should bite about evenly when the plates are fully pivoted outwardly. For this reason, the tips 45 of the teeth are formed so that they lie on a cylindrical surface of revolution coaxial with the tool when the plates are fully embedded in the pipe. Then the teeth can effectively function as a gripper, and also as a tap, if necessary.

As best shown in FIG. 4, the teeth have a pitch angle. The angle is a locking angle between the teeth and the pipe, so that an axial pull will not cause rotation at this point. They are formed as cutting elements in accordance with conventional thread tapping art.

An added feature of the invention is provision of means to remove sediment ahead of the tool, so that the tool can reach the pipe, and so the pipe can be fully seated in the socket 28. Bore 56 terminates in one or more ports 58 in the pointed end of the spear. They permit delivery of a fluid under pressure to the region below the tool. Channels 60 are angled outwardly from socket 28 and through the bell-mouth centering means. This enables fluid to pass through the tool from bottom to top to carry away undesirable detritus.

In operation, the tool is attached to string 22 by means of thread 20 on spear 16, with the bell-mouth means 14 latched to it by means of the ball and socket latch. The tool is then inserted in the well to the approximate depth of the face end of pipe string 12. Water or fluid such as drilling mud may then (or sooner) be forced through bore 56 to ports 58 to clear any sediment around the pipe end 12 by forcing it upward through channels 60 in the bell-mouth centering means. The tool can then continue its downward movement until the free end of pipe 12 engages the tapered surface, and is forced by the surface toward the center and into socket 28. In this manner the free end of pipe 12 is centered and is forced into socket 28 as shown in FIG. 2.

At this point, continued downward thrust on cylindrical shaft 16 will release ball and socket latch 17, allowing the spear to be inserted into the end of pipe 12 until the teeth are fully inside the pipe. A subsequent upward axial force on cylindrical shaft 16 will then cause teeth 44 on plates 42 to securely bit into the interior surface of pipe 12, thereby locking the pipe in socket 28. The pipe string may then be withdrawn from the well bore hole by pulling up on the tool.

After withdrawal, the cylindrical shaft may be removed from the pipe by rotational movement which will cause barbs 44 to tap a thread in the interior surface of the pipe as it is threaded out of the end. If it cannot bring the pipe to the surface, then such rotation can occur down-well, and the tool can be recovered. When the tool is brought up, either the teeth will have engaged the wall of passage 15, or the latch will have re-engaged to bring up the entire tool. In either event, the entire tool will be returned to the surface.

The term "bell-mouth" is used to mean an open cavity having a decreasing inside diameter. The terms "teeth" and "barb" are used interchangeably. The term "tooth" is not limited to a thread-cutting tooth. Teeth which merely engage, and which do not tap their way out, are also contemplated by this invention.

This invention is not to be limited by the embodiment shown in the drawings and described in the description which is given by way of example and not of limitation, but only in accordance with the scope of the appended claims.

I claim:

1. A pipe retrieval tool comprising:

bell-mouth centering means having an axis, and an interior tapered wall extending from a larger diameter near its lower end to a smaller diameter axially spaced from said lower end, a socket intersecting said tapered wall near its smaller diameter, said socket having a seat and a surrounding wall to receive and align the end of a pipe to be retrieved, said centering means also having an axial passage therethrough; and a spear axially slidably fitted in said passage, said spear bearing on its surface uni-directional gripping means permitting sliding movement of said spear into said pipe in one direction, and engaging said pipe to prevent axial separation in the other direction, said gripping means comprising a plate having on its outside wall a plurality of teeth, said spear having a recess to receive said plate, said plate being rotationally mounted so as to withdraw into said recess, and to tilt to extend laterally beyond the said spear, and bias means biasing the plate outwardly, said teeth being formed with sharp edges formed as a thread tap, whereby to dig into the pipe when the tool is pulled away from the pipe, and whereby to cut their way out of the pipe when rotated relative to it by cutting a thread and following it.

2. A tool according to claim 1 in which said recess has walls engaged to and supporting said plate against sidewise movement.

3. A tool according to claim 2 in which said recess is undercut at its axially-lowest end, and receives said plate whereby to mount it for rotation.

4. A tool according to claim 3 in which a retainer ring surrounds said plate and spear to hold the plate in place.

5. A tool according to claim 3 in which said bias means comprise a spring seated in said recess.

6. A tool according to claim 1 in which said plate thins toward its upper end, whereby the tips of said teeth lie on a surface of revolution when said plate is thrust outwardly and into full engagement with said pipe.

7. A tool according to claim 1 in which latching means is provided holding said spear to said centering means with said spear withdrawn into said socket so as not to impede the entry of the pipe into said socket, and to release said spear to enter said pipe when said pipe is seated in said socket.

* * * * *